US008098211B2

(12) United States Patent
Onaka et al.

(10) Patent No.: US 8,098,211 B2
(45) Date of Patent: Jan. 17, 2012

(54) ANTENNA STRUCTURE AND RADIO COMMUNICATION APPARATUS INCLUDING THE SAME

(75) Inventors: Kengo Onaka, Ishikawa-ken (JP); Kunihiro Komaki, Hakusan (JP); Tsuyoshi Mukai, Hakusan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 252 days.

(21) Appl. No.: 12/488,084

(22) Filed: Jun. 19, 2009

(65) Prior Publication Data

US 2009/0256771 A1 Oct. 15, 2009

Related U.S. Application Data

(63) Continuation of application No. PCT/JP2007/068278, filed on Sep. 20, 2007.

(30) Foreign Application Priority Data

Dec. 22, 2006 (JP) ..... 2006-346145

(51) Int. Cl.
*H01Q 1/00* (2006.01)
*H01Q 7/00* (2006.01)

(52) U.S. Cl. ..... 343/866; 343/700 MS; 343/729

(58) Field of Classification Search ..... 343/724, 343/729, 748, 752, 866
See application file for complete search history.

(56) References Cited

U.S. PATENT DOCUMENTS 4,074,270 A * 2/1978 Kaloi ..... 343/700 MS
6,111,545 A 8/2000 Saari
6,657,593 B2 * 12/2003 Nagumo et al. ..... 343/700 MS
6,680,708 B2 * 1/2004 Yamaki ..... 343/741
6,734,825 B1 5/2004 Guo et al.
7,375,695 B2 5/2008 Ishizuka et al.
2002/0005809 A1 1/2002 Manteuffel et al.
2007/0139270 A1 6/2007 Takei et al.

FOREIGN PATENT DOCUMENTS

EP 1 154 518 A2 11/2001
GB 2 317 994 A 4/1998
JP 11-88032 3/1999
JP 2003-142936 5/2003

(Continued)

OTHER PUBLICATIONS

International Search Report with English language translation, Dec. 2007.

(Continued)

*Primary Examiner* — Douglas W Owens
*Assistant Examiner* — Jennifer F Hu
(74) *Attorney, Agent, or Firm* — Keating & Bennett, LLP

(57) ABSTRACT

A feed radiation electrode functioning as an antenna is capable of performing radio communication in two different frequency bands, a lower frequency band and a higher frequency band, defined in advance for radio communication. The feed radiation electrode has a loop shape, and a feeding end Q and a feeding-end adjacent portion P are connected with a shortcut path, which is provided by a stub, therebetween. Thus, the feed radiation electrode is capable of performing radio communication in the lower frequency band for radio communication in accordance with a resonant operation based on a current flowing through a channel IL and performing radio communication in the higher frequency band for radio communication in accordance with a resonant operation based on currents flowing through channels $I_H$ and $I_H'$.

13 Claims, 7 Drawing Sheets

FOREIGN PATENT DOCUMENTS

| | | |
|---|---|---|
| JP | 2004-96314 | 3/2004 |
| JP | 2004-266526 | 9/2004 |
| JP | 2005-217623 | 8/2005 |
| JP | 2006-504328 | 2/2006 |
| WO | 2005/048404 | 5/2005 |
| WO | 2006/080141 | 8/2006 |
| WO | 2006/134701 | 12/2006 |

OTHER PUBLICATIONS

Written Opinion with English language translation, Dec. 2007.

Official Communication issued in corresponding European Patent Application No. 07807642.9, mailed on Feb. 2, 2010.

* cited by examiner

ANTENNA STRUCTURE AND RADIO COMMUNICATION APPARATUS INCLUDING THE SAME

CROSS-REFERENCE TO RELATED APPLICATIONS

This is a continuation under 35 U.S.C. §111(a) of PCT/JP2007/068278 filed Sep. 20, 2007, and claims priority of JP2006-346145 filed Dec. 22, 2006, both incorporated by reference.

BACKGROUND

1. Technical Field

The present invention relates to an antenna structure provided for a radio communication apparatus, such as a cellular phone, and a radio communication apparatus including such an antenna structure.

2. Background Art

FIG. 9*a* schematically shows an example of an antenna structure (see, for example, Patent Document 1). An antenna structure 40 includes a bar-shaped radiation conductor 41, a coaxial cable 42, and a feeder line 43. The bar-shaped radiation conductor 41 functions as an antenna in accordance with a resonant operation and has a line length X (X=λ/4), which is approximately one-quarter the wavelength λ of a radio wave at a resonant frequency set in a frequency band defined in advance for radio communication. The coaxial cable 42 includes an internal conductor (core wire) 42*a* and an external conductor 42*b* that is arranged circumferentially around the internal conductor 42*a* with a gap therebetween. A rear end of the coaxial cable 42 (the left end in FIG. 9*a*) serves as a connection end, and one end of the feeder line 43 is connected to a connection end of the internal conductor 42*a* of the coaxial cable 42. The other end of the feeder line 43 is electrically connected to a radio communication circuit 44 provided in a radio communication apparatus. In addition, a connection end of the external conductor 42*b* of the coaxial cable 42 is electrically connected via a lead D to one end (a rear end) of the radiation conductor 41.

The coaxial cable 42 functions as an impedance circuit for achieving impedance matching between the radiation conductor 41 and the radio communication circuit 44. The coaxial cable 42 functions as an inductance as represented by an equivalent circuit shown in FIG. 9*b* or functions as a capacitor as represented by an equivalent circuit shown in FIG. 9*c*, by appropriately setting the state of connection between a leading end of the internal conductor 42*a* and a leading end of the external conductor 42*b* (that is, whether or not the leading ends are connected to each other) and setting the line length of the coaxial cable 42. Thus, the state of the connection between the leading ends of the internal conductor 42*a* and the external conductor 42*b* of the coaxial cable 42, the line length of the coaxial cable 42, and other factors known to those skilled in the art, are set in an appropriate manner such that impedance matching between the radiation conductor 41 and the radio communication circuit 44 can be achieved.

The antenna structure 40 is configured as described above. For example, when a transmission signal is transmitted from the radio communication circuit 44 via the feeder line 43 and the coaxial cable 42 to the radiation conductor 41, the transmission of the signal causes the radiation conductor 41 to perform a resonant operation and the signal is radio-transmitted. In addition, when a signal arrives at the radiation conductor 41 and the radiation conductor 41 performs a resonant operation and receives the signal, the received signal is transmitted via the coaxial cable 42 and the feeder line 43 to the radio communication circuit 44.

FIG. 10 shows an example of another form of antenna structure (see, for example, Patent Document 2). An antenna structure 45 shown in FIG. 10 is capable of implementing radio communication in two different radio communication frequency bands. The antenna structure 45 includes a line-shaped antenna element 46 and a trap circuit 47. The line-shaped antenna element 46 performs transmission and reception of radio waves in accordance with a resonant operation. One end of the line-shaped antenna 46 (the left end in FIG. 10) serves as a feeding end, and the feeding end is electrically connected to a radio communication circuit 48. In addition, the other end of the line-shaped antenna element 46 (the right end in FIG. 10) serves as an open end. The line-shaped antenna element 46 has the configuration described below, such that the line-shaped antenna element 46 is capable of functioning as an antenna by resonating in two different frequency bands defined in advance for radio communication.

That is, the line-shaped antenna element 46 is caused to perform a resonant operation at a resonant frequency $F_{low}$ set in the lower frequency band of the two different frequency bands defined in advance for radio communication, and a resonant operation at a resonant frequency $F_{hi}$ set in the higher frequency band of the two different frequency bands defined in advance for radio communication. To achieve such operation, the trap circuit 47 is provided in the line-shaped antenna element 46. The trap circuit 47 is provided in the line-shaped antenna element 46 at a position where the electrical length Y from the feeding end is the same as one-quarter the wavelength $\lambda_{hi}$ of a radio wave at the resonant frequency $F_{hi}$ set in the higher frequency band for radio communication. The trap circuit 47 is an LC resonant circuit including a capacitor 49 and an inductor 50. The capacitance of the capacitor 49 and the inductance of the inductor 50 are set such that antiresonance occurs at the resonant frequency $F_{hi}$ set in the higher frequency band for radio communication. Due to the provision of the trap circuit 47, when the open end is viewed from the feeding end of the line-shaped antenna element 46 at the resonant frequency $F_{hi}$ set in the higher frequency band for radio communication, in the antenna element 46, an area from the trap circuit 47 to the open end is not electrically visible. Thus, in the case of radio communication in the higher frequency band for radio communication, in the line-shaped antenna element 46, an area from the feeding end to the position where the trap circuit 47 is provided resonates at the resonant frequency $F_{hi}$, and thus radio communication is implemented.

In addition, in terms of the resonant frequency $F_{low}$ set in the lower frequency band for radio communication, the trap circuit 47 functions as a circuit for providing a reactance to the line-shaped antenna element 46. Thus, the line-shaped antenna element 46 is designed such that the electric length (electrical length) from the feeding end to the open end of the line-shaped antenna element 46 is approximately one-quarter the wavelength $\lambda_{low}$ of a radio wave at the resonant frequency $F_{low}$ set in the lower frequency band for radio communication while taking into consideration the reactance to be provided. Thus, in the case of radio communication in the lower frequency band for radio communication, the entire line-shaped antenna element 46 resonates at the resonant frequency $F_{low}$ set in the lower frequency band for radio communication, and thus radio communication is implemented.

Patent Document 1: Japanese Unexamined Patent Application Publication No. 2004-266526

Patent Document 2: Japanese Unexamined Patent Application Publication No. 11-88032

In the configuration of the antenna structure 40 shown in FIG. 9*a*, for example, in order to connect the radiation conductor 41 to the coaxial cable 42, a process to achieve connection between the radiation conductor 41 and the lead D and connection between the coaxial cable 42 and the lead D, by soldering or the like, is necessary. Thus, a problem occurs in which a manufacturing process becomes more complicated. In addition, there is another problem, in that it is troublesome to carry out assembly processing (positioning) of the radiation conductor 41, the lead D, and the coaxial cable 42 in such a connecting process. As stated above, since it takes much time and effort to produce the antenna structure 40, there is a problem in which the manufacturing cost of the antenna structure 40 increases. Furthermore, since the connection status of the portions connected by soldering cannot be maintained constant all the time, there is another problem in which a variation in the antenna characteristic occurs due to a variation in the connection status of the connected portions.

Regarding the antenna structure 45 shown in FIG. 10, since the trap circuit 47 must be built in the line-shaped antenna element 46, there is a problem in which the manufacturing process becomes more complicated. In addition, there is another problem in which a variation in the antenna characteristic occurs due to a variation in the position in which the trap circuit 47 is built.

SUMMARY

To solve the above-described problems, in the configuration described below, an antenna structure is capable of implementing radio communication in two different frequency bands, a higher frequency band and a lower frequency band, for radio communication, including a feed radiation electrode that is formed on a surface associated with a circuit board, which may include a surface of a circuit board or at least one surface of a base member provided on the circuit board, and functions as an antenna in accordance with a resonant operation. One end of the feed radiation electrode serves as a feeding end and the other end of the feed radiation electrode serves as an open end. An electrical length from the feeding end to the open end of the feed radiation electrode is the same as an electrical length in which the feed radiation electrode performs a resonant operation at a resonant frequency set in the lower frequency band for the radio communication. The feed radiation electrode has a loop shape such that the feed radiation electrode starts at the feeding end, extends in a forward direction that is directed away from the feeding end, turns around so as to extend in a backward direction that approaches the feeding end, passes through a feeding-end adjacent portion that is arranged adjacent to the feeding end with a gap therebetween, and reaches the open end. The feeding-end adjacent portion and the feeding end of the feed radiation electrode are electrically connected by a shortcut path therebetween, the shortcut path being provided by a stub.

In addition, a radio communication apparatus is disclosed, including an antenna structure having a configuration characteristic as described above.

The antenna structure is preferably configured such that the feed radiation electrode has a loop shape and the feeding end and the feeding-end adjacent portion of the feed radiation electrode having the loop shape are connected with the shortcut path therebetween, the shortcut path being provided with the stub. Thus, for example, when radio communication in the higher frequency band for the radio communication is performed, in the feed radiation electrode, currents flow through the two channels described below. The two channels are a channel starting from the feeding end of the feed radiation electrode, passing through an extension portion in the forward direction of the loop shape, and extending toward a folded area in an extension direction of the feed radiation electrode and a channel starting from the feeding end, passing through the shortcut path and the feeding-end adjacent portion, extending along an extension portion in the backward direction of the loop shape, and extending toward the folded area in the extension direction of the feed radiation electrode. The currents flow as described above, and the feed radiation electrode performs a resonant operation at the resonant frequency set in the higher frequency band for the radio communication. In addition, when radio communication in the lower frequency band for the radio communication is performed, in the feed radiation electrode, a current flows through a channel starting from the feeding end, passing through the extension portion in the forward direction and the extension portion in the backward direction of the loop shape in that order, and extending toward the open end. Thus, the feed radiation electrode performs a resonant operation at the resonant frequency set in the lower frequency band for the radio communication. With the configuration of the antenna structure described herein, radio communication in the two different frequency bands can be achieved by the two different conductive channels for a current in the feed radiation electrode, as described above.

In the configuration of the antenna structure, with a simple configuration in which the feeding end and the feeding-end adjacent portion of the feed radiation electrode having the loop shape are connected with the shortcut path therebetween, the shortcut path being provided with the stub, radio communication in two different frequency bands can be achieved with only a single feed radiation electrode. Moreover, the feed radiation electrode is advantageously formed on the board surface of the circuit board or on at least one surface of the base member provided on the circuit board, and with a wavelength shortening effect due to the dielectric constant of the circuit board or the base member, the size of the feed radiation electrode can be reduced. As described above, since a simplified configuration and a size-reduced feed radiation electrode can be achieved, a size-reduced antenna structure capable of implementing radio communication in two different frequency bands and a radio communication apparatus including such an antenna structure can be provided.

In addition, regarding the feed radiation electrode, a conductive plate can be manufactured by sheet metal processing including bending and drawing. Thus, a simplified manufacturing process and a reduced manufacturing cost of the feed radiation electrode can be achieved.

As a configuration allowing a single feed radiation electrode to perform radio communication in two different frequency bands, a configuration using, from among a plurality of resonant modes of the feed radiation electrode, a fundamental mode at the lowest frequency and a higher mode at a frequency higher than the lowest frequency, is available. That is, in the case of this configuration, radio communication in the lower frequency band for radio communication is performed in accordance with a resonant operation of the feed radiation electrode in the fundamental mode and radio communication in the higher frequency band for radio communication is performed in accordance with a resonant operation of the feed radiation electrode in the higher mode. In the case of this configuration, regarding the relationship between an electrical length defining the resonant frequency in the fundamental mode of the feed radiation electrode and an electrical length defining the resonant frequency in the higher mode, there is a relationship in which the electrical length in the fundamental mode is approximately (2n+1) times (n=1, 2, 3 . . . ) as long as the electrical length in the higher mode. Under such a relational constraint, it is difficult to individually set a lower frequency band and a higher frequency band for radio communication.

In contrast, according to the disclosed antenna structure, with the configuration in which radio communication is performed in two different frequency bands by switching a conductive channel for a current in the feed radiation electrode as described above, the resonant frequency in the lower frequency band for radio communication in the feed radiation electrode can be adjusted on the basis of the electrical length from the feeding end to the open end of the feed radiation electrode. In addition, the resonant frequency in the higher frequency band for radio communication in the feed radiation electrode can be adjusted on the basis of the electrical length starting from the feeding end, passing through the extension portion in the forward direction of the loop shape, and reaching the folded area in the extension direction of the feed radiation electrode (the electrical length starting from the feeding end, passing through the shortcut path and the feeding-end adjacent portion, extending along the extension portion in the backward direction of the loop shape, and reaching the folded area in the extension direction of the feed radiation electrode), that is, the electrical length from the feeding end to the feeding-end adjacent portion. The position where the feeding-end adjacent portion is to be located is irrespective of the electrical length from the feeding end to the open end, that is, the position where the feeding-end adjacent portion is to be located can be set without a constraint of the resonant frequency in the lower frequency band for radio communication in the feed radiation electrode. That is, setting can be achieved without restraining the lower frequency band and the higher frequency band for radio communication. Thus, the flexibility in design of an antenna structure can be increased.

In addition, in the case of a configuration in which radio communication in a plurality of frequency bands can be implemented by using the resonant modes, the fundamental mode and the higher mode of the feed radiation electrode, the problem described below occurs. That is, since the wavelength in the higher mode is short compared with the wavelength in the fundamental mode, the cycle of crests and troughs (density) of an electromagnetic field is short in the higher mode. Thus, in the case that in order to control the higher mode, the feed radiation electrode has a shape having a folded area or the feed radiation electrode has a meander line shape and the feed radiation electrode having the meander line shape is cut short, concentration in the electromagnetic field is likely to occur. Thus, in the higher mode, a problem occurs in which the frequency bandwidth is reduced and antenna characteristics, such as an antenna efficiency and an antenna gain, are deteriorated.

In contrast, according to the disclosed antenna structure, for example, since radio communication is performed in two different frequency bands by switching a conductive channel for a current in the feed radiation electrode as described above, in the case that radio communication in the lower frequency band for radio communication is performed, radio communication is performed in accordance with a resonant operation in the fundamental mode with the entire electrode radiation electrode from the feeding end to the open end. In addition, in the case that radio communication in the higher frequency band for radio communication is performed, radio communication is performed in accordance with a resonant operation in the fundamental mode with a portion of the feed radiation electrode starting from the feeding end of the feed radiation electrode to the folded area in the extension direction of the feed radiation electrode having the loop shape. That is, with a single feed radiation electrode, not only the resonant operation in the lower frequency band for radio communication but also the resonant operation in the higher frequency band for radio communication serves as a resonance in the fundamental mode. Thus, concentration in an electromagnetic field, which is problematic in the higher mode, can be avoided. Therefore, an increase in the width of the higher frequency band for radio communication and improvements in the antenna characteristics, such as an antenna efficiency and an antenna gain, can be easily achieved.

In addition, the size of an area through which a current flows in the feed radiation electrode affects the antenna characteristics, such as the antenna gain and bandwidth. In order to improve the antenna characteristics, it is desirable that the size of the area through which a current flows is large. However, the electrical length enabling a resonant operation in the higher frequency band for radio communication is shorter than the electrical length enabling a resonant operation in the lower frequency band for radio communication, and the size of an area through which a current flows in the resonant operation in the higher frequency band for radio communication is smaller than the size of an area through which a current flows in the resonant operation in the lower frequency band for radio communication. Thus, since the electrical volume in the higher frequency band for radio communication is smaller than the electrical volume in the lower frequency band for radio communication, the antenna characteristics in the higher frequency band for radio communication are worse than the antenna characteristics in the lower frequency band for radio communication.

In contrast, as disclosed herein, for example, since radio communication is performed in two different frequency bands by switching a conductive channel for a current in the feed radiation electrode as described above, in the case that a resonant operation in the lower frequency band for radio communication is performed, a current flows through a channel starting from the feeding end of the feed radiation electrode, passing through the extension portion in the forward direction and the extension portion in the backward direction of the loop shape in that order, and extending toward the open end. In addition, in the case that a resonant operation in the higher frequency band for radio communication is performed, currents flow through two channels, a direction starting from the feeding end, passing through the shortcut path, extending along the extension portion in the backward direction of the loop shape, and extending toward the folded area in the extension direction of the feed radiation electrode and a direction starting from the feeding end, passing through the extension portion in the forward direction of the loop shape, and extending toward the folded area in the extension direction of the feed radiation electrode. That is, both in the resonant operation in the higher frequency band for radio communication and the resonant operation in the lower frequency band for radio communication, the resonant operation is performed while a current flows through the entire loop shape of the feed radiation electrode, and the size of an area through which a current flows in the resonant operation in the higher frequency band for radio communication is the same as the size of an area through which a current flows in the resonant operation in the lower frequency band for radio communication. Thus, a deterioration in the antenna characteristics in the higher frequency band for radio communication due to the size of an area through which a current flows can be suppressed. In addition, the resonant operation in the higher frequency band for radio communication can be operated in the fundamental mode, as in the resonant operation in the lower frequency band for radio communication.

Other features and advantages will become apparent from the following description of embodiments, which refers to the accompanying drawings.

DETAILED DESCRIPTION

Reference Numerals

Figure 1A:
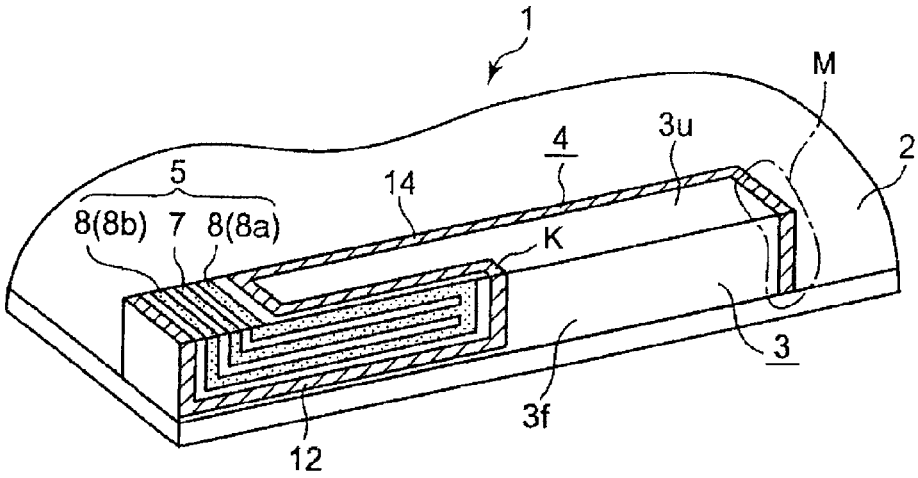
FIG. 1*a* is a perspective view schematically showing an antenna structure according to a first embodiment.

1 antenna structure
2 circuit board
3 base member
4 feed radiation electrode
5, 21 stub
7, 22 central conductor
8, 23 external conductor
11 shortcut path
12 branch electrode
15, 16 shielding member
20 parasitic radiation electrode Embodiments of the present invention will be described with reference to the drawings.

Figure 1B:
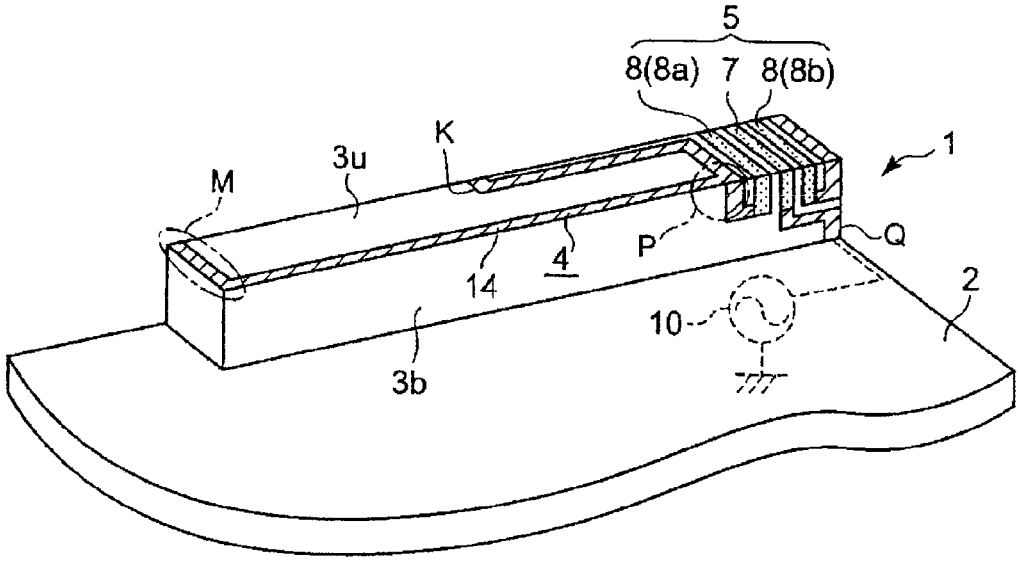
FIG. 1*b* is a perspective view schematically showing the antenna structure according to the first embodiment when viewed from a back side of FIG. 1*a*.
Figure 1C:
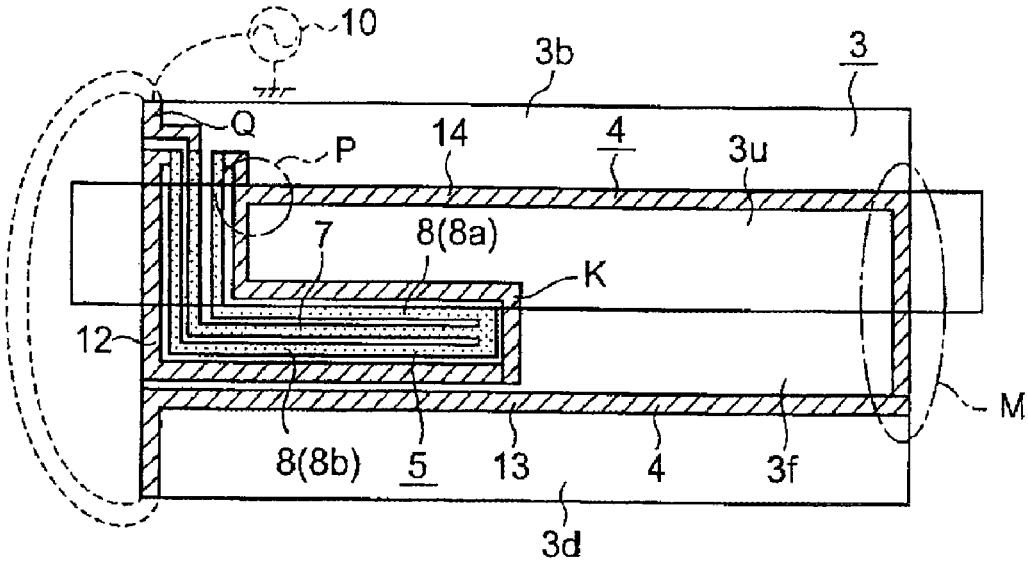
FIG. 1*c* is a schematic development view of a feed radiation electrode and a stub constituting the antenna structure shown in FIG. 1*a*.

FIG. 1*a* is a schematic perspective view showing an antenna structure according to a first embodiment, and FIG. 1*b* schematically shows the antenna structure when viewed from a back side of FIG. 1*a*. An antenna structure 1 according to the first embodiment includes a base member 3, which is a dielectric, provided on a circuit board 2 of a radio communication apparatus (for example, a cellular phone), a feed radiation electrode 4 formed on the base member 3, and a stub 5 connected to the feed radiation electrode 4. In the first embodiment, the base member 3 is a rectangular parallelepiped. The feed radiation electrode 4 and the stub 5, which will be described next, are formed on a plurality of surfaces of the base member 3. FIG. 1*c* is a development view of the base member 3 on which the feed radiation electrode 4 and the stub 5 are formed.

The stub 5 is formed of a conductive plate, and the stub (short stub) 5 includes, as shown in FIGS. 1*a* to 1*c*, a line-shaped central conductor 7 and line-shaped external conductors 8 (8*a* and 8*b*) arranged and provided so as to sandwich the central conductor 7 on both sides with gaps therebetween. In the first embodiment, the central conductor 7 and the external conductors 8*a* and 8*b* are provided in parallel with each other, and the size of the gap between the central conductor 7 and the external conductor 8*a* and the size of the gap between the central conductor 7 and the external conductor 8*b* are the same. The central conductor 7 and the external conductors 8*a* and 8*b* extend from a back surface 3*b* through an upper surface 3*u* to a front surface 3*f* of the base member 3. Ends of the central conductor 7 and the external conductors 8*a* and 8*b* that are formed on the back surface 3*b* of the base member 3 are rear ends, and ends of the central conductor 7 and the external conductors 8*a* and 8*b* that are formed on the front surface 3*f* of the base member 3 are leading ends. The lending ends of the central conductor 7 and the external conductors 8*a* and 8*b* are electrically connected to each other and serve as connection ends.

Figure 2:
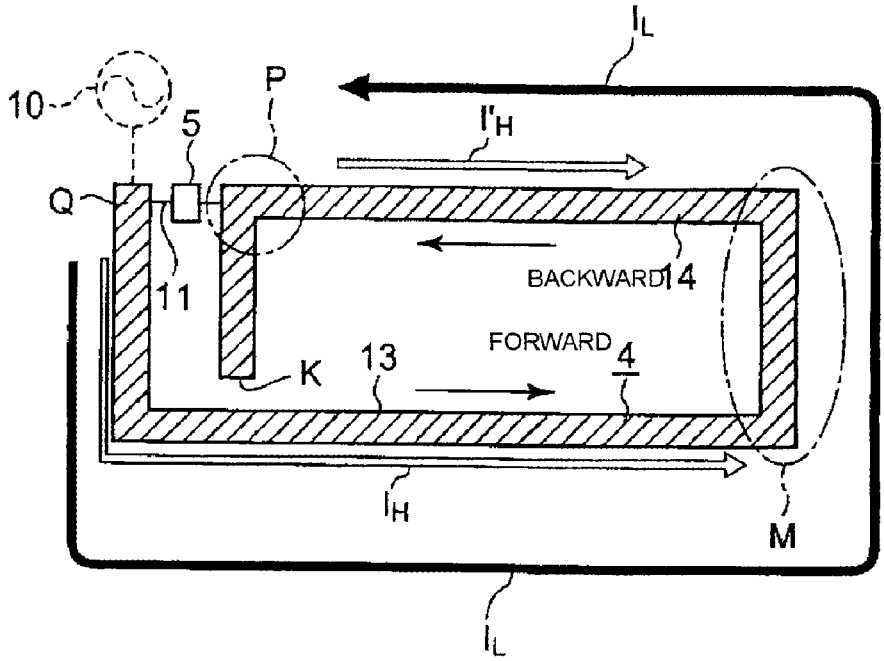
FIG. 2 is an illustration for explaining an example of the shapes of the feed radiation electrode and the stub constituting the antenna structure according to the first embodiment and the connection state of the feed radiation electrode and the stub.

The feed radiation electrode 4 is a radiation electrode of a $\lambda/4$ type formed of a conductive plate. FIG. 2 shows in a simplified manner the feed radiation electrode 4. First, the configuration of the feed radiation electrode 4 will be briefly explained with reference to FIG. 2.

One end Q of the feed radiation electrode 4 serves as a feeding end that is electrically connected to a radio communication circuit 10 provided in the radio communication apparatus, and the other end of the feed radiation electrode 4 serves as an open end K. The feed radiation electrode 4 has a loop shape. That is, the feed radiation electrode 4 has a loop shape such that the feed radiation electrode 4 starts from the feeding end Q, extends in a forward direction that is directed away from the feeding end Q, turns around in a backward direction that approaches the feeding end Q, passes through a feeding-end adjacent portion P, which is located adjacent to the feeding end Q with a gap therebetween, and reaches the open end K. The feeding-end adjacent portion P and the feeding end Q of the feed radiation electrode 4 are electrically connected through a shortcut path 11 in which the stub 5 is provided.

In the first embodiment, two different frequency bands, a higher frequency band (for example, a band of 2 GHz) and a lower frequency band (for example, a band of 900 MHz) for radio communication, are defined in advance as frequency bands for radio communication. The total electrical length of the feed radiation electrode 4 from the feeding end Q to the open end K is the same as an electrical length in which the feed radiation electrode 4 performs a resonant operation at a resonant frequency $F_L$ for a feed radiation electrode set in the lower frequency band for radio communication. In addition, the electrical length starting from the feeding end Q of the feed radiation electrode 4, passing through an extension portion 13 in the forward direction of the loop shape, and reaching a folded area M in an extension direction is similar to the electrical length starting from the feeding end Q, passing through the shortcut path 11 and the feeding-end adjacent portion P, extending along an extension portion 14 in the backward direction of the loop shape, and reaching the folded area M in the extension direction. This electrical length is the same as an electrical length in which the feed radiation electrode 4 performs a resonant operation at a resonant frequency $F_H$ for a feed radiation electrode set in the higher frequency band for radio communication. Furthermore, the stub 5 is formed so as to have an impedance characteristic in which the stub 5 appears to have a high impedance (preferably, open) when a leading end of the stub is viewed from the feeding end Q at the resonant frequency $F_L$ for a feed radiation electrode set in the lower frequency band for radio communication and the stub 5 appears to have a low impedance (preferably, short-circuited) when the leading end of the stub is viewed from the feeding end Q at the resonant frequency $F_H$ for a feed radiation electrode set in the higher frequency band for radio communication.

The feed radiation electrode 4 has the loop shape as described above, the feed radiation electrode 4 has the electrical lengths as described above, the feeding end Q and the feeding-end adjacent portion P are connected through the shortcut path 11 provided by the stub 5, and the stub 5 has the impedance characteristic as described above. Thus, the feed radiation electrode 4 operates as described below when radio communication is performed. That is, in the case of radio communication in the lower frequency band for radio communication, when the stub 5 is viewed from the feeding end Q of the feed radiation electrode 4, the stub 5 appears to have a high impedance. Thus, a current does not flow through the shortcut path 11. That is, the shortcut path 11 is in a non-conductive state. Thus, in the feed radiation electrode 4, a current flows through a channel IL, which starts from the feeding end Q, passes through the extension portion 13 in the forward direction and the extension portion 14 in the backward direction of the loop shape in that order, and extends toward to the open end K, and the feed radiation electrode 4 resonates at the lower resonant frequency $F_L$ set for radio communication, thus achieving radio communication.

In addition, in the case of radio communication in the higher frequency band for radio communication, when the stub 5 is viewed from the feeding end Q of the feed radiation electrode 4, the stub 5 appears to have a low impedance. Thus, a current flows through the shortcut path 11. That is, the shortcut path 11 is in a conductive state. Thus, in the feed radiation electrode 4, currents flow through two channels, a channel $I_H$, which starts from the feeding end Q, passes through the extension portion 13 in the forward direction of the loop shape, and extends toward the folded area M in the extension direction of the feed radiation electrode 4, and a channel $I_{H'}$, which starts from the feeding end Q, passes through the extension portion 14 in the backward direction of the loop shape, and extends toward to the folded area M in the extension direction of the feed radiation electrode 4, and the feed radiation electrode 4 resonates at the higher resonant frequency $F_H$ set for radio communication, thus achieving radio communication.

In the first embodiment, as described above, the stub 5 is configured such that the stub 5 appears to have a high impedance when the stub 5 is viewed from the feeding end Q of the feed radiation electrode 4 at the resonant frequency set in the lower frequency band for radio communication and the stub 5 appears to have a low impedance when the stub 5 is viewed from the feeding end Q of the feed radiation electrode 4 at the resonant frequency set in the higher frequency band for radio communication. Thus, conduction loss in the shortcut path 11 can be suppressed, and a deterioration in the antenna characteristic to be caused by such conduction loss can be suppressed.

The feed radiation electrode 4 shown in each of FIGS. 1*a* to 1*c* is a specific example of the feed radiation electrode 4 having the above-described configuration. That is, in the example shown in FIGS. 1*a* to 1*c*, the feeding end Q of the feed radiation electrode 4 is provided at a lower end corner of the back surface 3*b* of the base member 3. The feed radiation electrode 4 has a loop shape such that the feed radiation electrode 4 starts from the feeding end Q, extends along edges of a bottom surface 3*d* of the base member 3 to a position diagonal to a position where the feeding end Q is formed on the bottom surface 3*d*, passes through the front surface 3*f* of the base member 3, extends on the upper surface 3*u*, turns around, on the upper surface 3*u*, so as to extend in an extension direction approaching the feeding end Q, passes through the feeding-end adjacent portion P, changes again the extension direction, and reaches the open end K.

The feeding end Q of the feed radiation electrode 4 is connected to the rear end of the central conductor 7 of the stub 5. In addition, the feeding-end adjacent portion P of the feed radiation electrode 4 is connected to the rear end of the external conductor 8 (8*a*) of the stub 5. A feed radiation electrode portion that is closer to the open end K than the feeding-end adjacent portion P (the position connected with the external conductor 8 (8*a*) of the stub 5) is arranged along the external conductor 8 (8*a*) with a gap therebetween. In addition, a branch electrode 12 that branches off from the feed radiation electrode portion that is closer to the open end K than the feeding-end adjacent portion P (in the example of FIGS. 1*a* to 1*c*, the open end K) is provided. The branch electrode 12 is arranged along the leading end of the stub 5 and the external conductor 8 (8*b*) with gaps therebetween and is connected to the rear end of the external conductor 8 (8*b*). That is, from the leading end of the stub 5, the stub 5 are surrounded on both sides by the feed radiation electrode portion that is closer to the open end K than the feeding-end adjacent portion P and the branch electrode 12 with gaps therebetween.

As described above, since the stub 5 is configured so as to be surrounded by the feed radiation electrode 4 and the branch electrode 12 with gaps therebetween, the feed radiation electrode 4 and the branch electrode 12 are capable of serving as shields against unwanted radio waves emitted from the stub 5. Thus, a problem in which unwanted radio waves emitted from the stub 5 are superimposed as noise on radio waves for radio communication by the feed radiation electrode 4 and a resultant degradation in the signal-to-noise ratio deteriorates the performance of radio communication can be avoided, and unwanted resonance in the stub 5 can be suppressed.

As described in the explanation of the configuration of the feed radiation electrode 4 shown in FIG. 2, in the feed radiation electrode 4 shown in each of FIGS. 1*a* to 1*c*, the total electrical length from the feeding end Q to the open end K is the same as the electrical length in which the feed radiation electrode 4 performs a resonant operation at the resonant frequency $F_L$ set in the lower frequency band for radio communication. In addition, the electrical length of the feed radiation electrode portion starting from the feeding end Q, passing through the extension portion 13 in the forward direction, and reaching the folded area M in the extension direction (the electrical length of the feed radiation electrode portion starting from the feeding end Q, passing through the feeding-end adjacent portion P and the extension portion 14 in the backward direction, and reaching the folded area M in the extension direction) is the same as the electrical length in which the feed radiation electrode 4 performs a resonant operation at the resonant frequency $F_H$ set in the higher frequency band for radio communication.

The feed radiation electrode 4 shown in each of FIGS. 1*a* to 1*c* is configured as described above. In addition, in the example shown in FIGS. 1*a* to 1*c*, the stub 5 also functions as the shortcut path 11. Thus, in the feed radiation electrode 4 shown in each of FIGS. 1*a* to 1*c*, in the case of radio communication in the lower frequency band for radio communication, due to a high impedance of the stub 5, in the feed radiation electrode 4, a current flows through a channel starting from the feeding end Q, passing through the extension portion (the portion where the feed radiation electrode 4 is formed on the bottom surface 3*d* of the base member 3) 13 in the forward direction and the extension portion (the portion where the feed radiation electrode 4 is formed on the upper surface 3*u* of the base member 3) 14 in the backward direction, and extending toward the open end K, and the feed radiation electrode 4 performs a resonant operation at the resonant frequency $F_L$ set in the lower frequency band for radio communication, thus achieving radio communication. In addition, in the case of radio communication in the higher frequency band for radio communication, due to a low impedance of the stub 5, in the feed radiation electrode 4, currents flow through two channels, a channel starting from the feeding end Q, shortcutting by using the stub 5, passing through the feeding-end adjacent portion P, extending along the extension portion (the portion where the feed radiation electrode 4 is formed on the upper surface 3*u* of the base member 3) 14 in the backward direction, and extending toward the folded area M in the extension direction, and a channel starting from the feeding end Q, passing through the extension portion (the portion where the feed radiation electrode 4 is formed on the bottom surface 3*d* of the base member 3) 13 in the forward direction, and extending toward the folded area M in the extension direction, and the feed radiation electrode 4 performs a resonant operation at the resonant frequency $F_H$ set in the higher frequency band for radio communication, thus achieving radio communication. In the configuration of the feed radiation electrode 4 shown in FIGS. 1*a* to 1*c*, an area through which a current flows in the case of radio communication in the lower frequency band for radio communication and an area through which a current flows in the case of radio communication in the higher frequency band for radio communication are the same, and the electrical volume of the antenna corresponds to the entire base member 3.

Figure 9A:
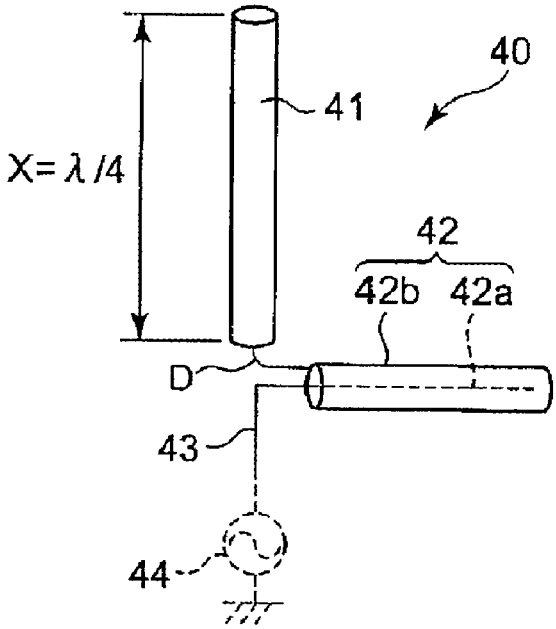
FIG. 9a PRIOR ART
FIG. 9*a* is an illustration for explaining an example of an antenna structure of the related art.
Figure 9B:
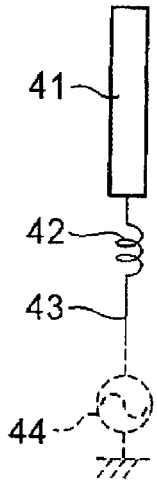
FIG. 9b PRIOR ART
FIG. 9*b* is an equivalent circuit diagram of the antenna structure in a case where a coaxial cable constituting the antenna structure shown in FIG. 9*a* functions as an inductance.
Figure 9C:
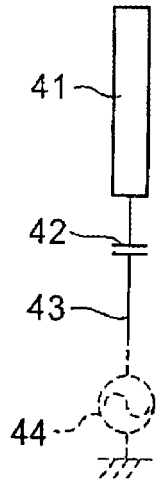
FIG. 9c PRIOR ART
FIG. 9*c* is an equivalent circuit diagram of the antenna structure in a case where the coaxial cable constituting the antenna structure shown in FIG. 9*a* functions as a capacitor.
Figure 10:
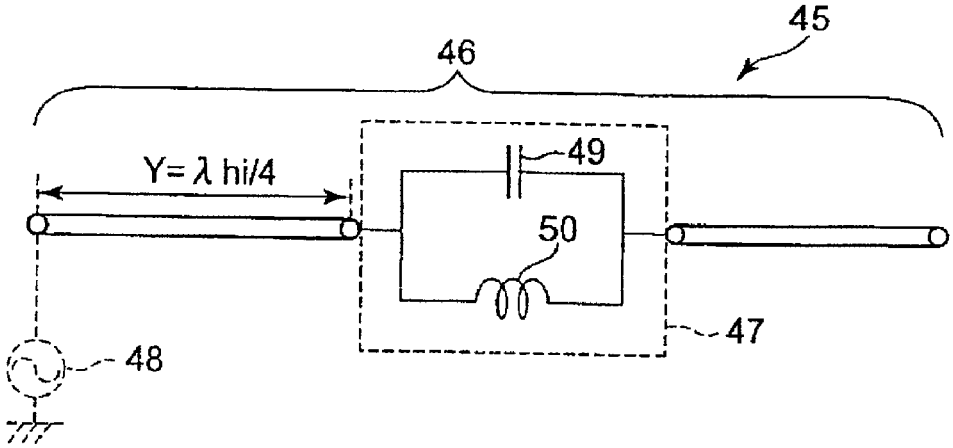
FIG. 10 PRIOR ART
FIG. 10 is an illustration for explaining another example of an antenna structure of the related art.

In general, a stub includes a central conductor and an external conductor that is arranged around the circumferential surface of the central conductor with a gap therebetween, as shown in FIG. 9*a*. In contrast, the stub 5 in the first embodiment has been conceived taking into consideration the provision on the base member 3, and ease of manufacturing. That is, the stub 5 includes the line-shaped central conductor 7 and the line-shaped external conductors 8*a* and 8*b* arranged and provided so as to sandwich the central conductor 7 on both sides with gaps therebetween. The shape of the stub 5 is different from the shape of a normal stub. The present inventor verified through an experiment that the stub 5 having a configuration specific to the first embodiment has an electric characteristic similar to that of a general stub.

Figure 3A:
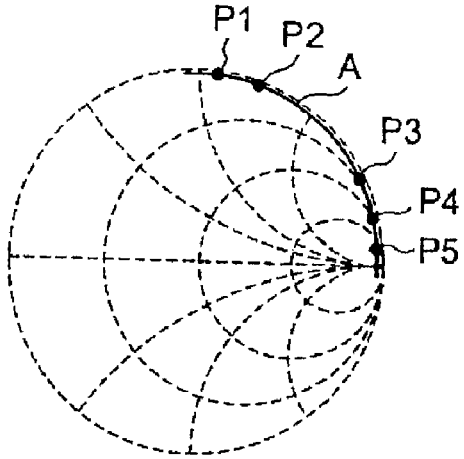
FIG. 3*a* is a chart schematically showing a sample used in an experiment conducted by the present inventor.
Figure 3B:
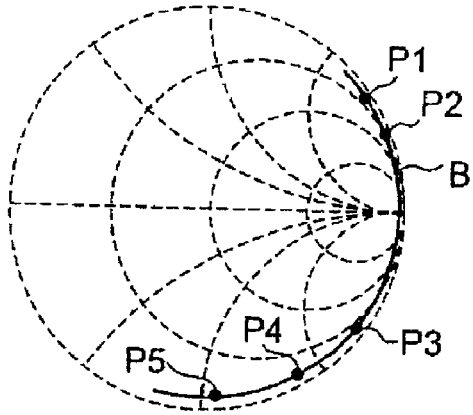
FIG. 3*b* is a chart for explaining a result of the experiment conducted by the present inventor.
Figure 3C:
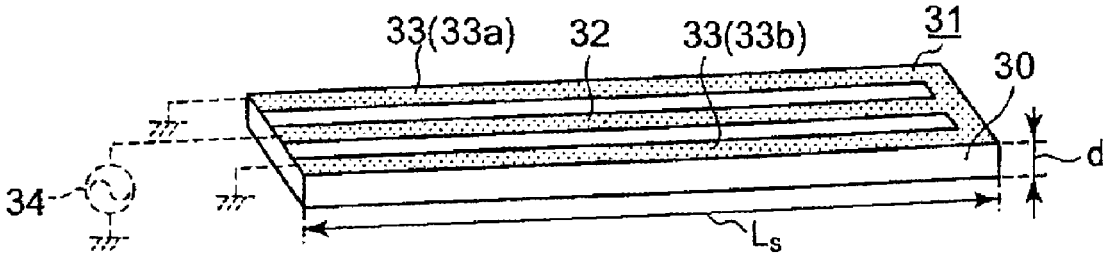
FIG. 3*c* is an illustration for explaining the result of the experiment conducted by the present inventor, as in FIG. 3*b*.

That is, in the experiment, a sample shown in FIG. 3*c* is prepared. Namely, the sample is configured such that a copper-foil stub 31 having a configuration the same as that of the stub 5 is provided on a dielectric base member (a base member having a thickness d of 1 mm and a relative dielectric constant $\epsilon$ of 6.4) 30. Abase end of a central conductor 32 of the stub 31 is connected to a feeder 34, and external conductors 33 (33*a* and 33*b*) of the stub 31 are grounded.

In the experiment, the frequency of a current supplied from the feeder 34 to the central conductor 32 of the stub 31 of the sample is varied in a frequency range from 700 MHz to 2300 MHz, and the impedance characteristic of the stub 31 in the frequency range in a case where the total length Ls of the stub 31 is 2 cm and the impedance characteristic of the stub 31 in the frequency range in a case where the total length Ls of the stub 31 is 4 cm are measured. An experimental result in the case where the total length Ls of the stub 31 is 2 cm is represented by a solid line A in a Smith chart shown in FIG. 3*a*, and an experimental result in the case where the total length Ls of the stub 31 is 4 cm is represented by a solid line B in a Smith chart shown in FIG. 3*b*. In each of FIGS. 3*a* and 3*b*, point P1 represents a value measured at a frequency of 824 MHz, point P2 represents a value measured at a frequency of 960 MHz, point P3 represents a value measured at a frequency of 1710 MHz, point P4 represents a value measured at a frequency of 1950 MHz, and point P5 represents a value measured at a frequency of 2170 MHz.

As is clear from the experimental results, the stub 31 having the configuration specific to the first embodiment has an impedance characteristic similar to that of a general stub.

The feed radiation electrode 4 and the stub 5 may be configured as described above. The feed radiation electrode 4 and the stub 5 are, for example, formed of the same conductive plate, and can be produced by the same process of sheet metal processing including drawing, bending, and the like. In addition, the feed radiation electrode 4 and the stub 5 produced as described above may be combined with the base member 3 that has been produced in advance in a different process such that the feed radiation electrode 4 and the stub 5 are formed integrally with the base member 3. For example, the base member 3 in which the feed radiation electrode 4 and the stub 5 are built may be produced by use of a molding technique, such as insert molding. In the case of using the molding technique, such as the insert molding technique, since manufacturing of the base member 3 and building of the feed radiation electrode 4 and the stub 5 in the base member 3 can be attained at the same time in the molding process of the base member 3, a manufacturing process can be simplified. Thus, the manufacturing cost can be reduced. In addition, since the manufacturing accuracy is increased, variations in the performance of the stub 5 and the feed radiation electrode 4 to be influenced by manufacturing accuracy can be reduced. Furthermore, since the stub 5 is produced from a conductive plate, from which the feed radiation electrode 4 is produced at the same by sheet metal processing, and formed integrally with the feed radiation electrode 4, the stub 5 can be connected to a set connection position of the feed radiation electrode 4. These advantages also serve as factors for reducing variations in the performance of the antenna structure.

In addition, in the first embodiment, the feed radiation electrode 4 and the stub 5 are formed on the base member 3, and the base member 3 is a part intended for use in an antenna structure. Thus, the base member 3 can have a dielectric constant higher than that of the circuit board 2, being under less constraint as to its dielectric constant in terms of design than the circuit board 2. Thus, in the case of the base member 3, a wavelength shortening effect to be exerted on the feed radiation electrode 4 and the stub 5 is large, compared with the case of the circuit board 2. Thus, with the configuration in which the feed radiation electrode 4 and the stub 5 are provided on the base member 3, reductions in the sizes of the feed radiation electrode 4 and the stub 5 can be easily achieved, compared with a case where the feed radiation electrode 4 and the stub 5 are provided on the circuit board 2.

As described above, the base member 3 in which the feed radiation electrode 4 and the stub 5 are provided integrally with each other is, for example, provided on the circuit board 2, as shown in FIGS. 1*a* and 1*b*. That is, in the first embodiment, the circuit board 2 has a rectangular shape having long sides and short sides, and the base member 3 advantageously may be provided in an edge portion of the circuit board 2 (preferably, a corner of the circuit board 2) such that the front surface 3*f* of the base member 3 faces a short side of the circuit board 2. Since the base member 3 is provided at a predetermined position of the circuit board 2, the feeding end Q of the feed radiation electrode 4 is electrically connected to the radio communication circuit 10 formed on the circuit board 2.

The antenna structure 1 according to the first embodiment is configured as described above. In the antenna structure 1, the feed radiation electrode 4 performs a resonant operation as described above and is capable of implementing radio communication in two different frequency bands, a lower frequency band and a higher frequency band, for radio communication. In the circuit board 2, a ground electrode (not shown), which serves as the ground for a circuit formed in the circuit board 2, is formed. In the first embodiment, since the feed radiation electrode 4 is a $\lambda/4$-type radiation electrode, a current caused by a resonant operation of the feed radiation electrode 4 is induced in the ground electrode of the circuit board 2 and the ground electrode also operates as an antenna. In addition, a casing in which the circuit board 2 is accommodated may also serve as the ground. In this case, a current caused by a resonant operation of the feed radiation electrode 4 may also be induced in the casing and the casing may also serve as an antenna.

A second embodiment will be described below. In the description of the second embodiment, the same parts as in the first embodiment are represented by the same reference numerals and the descriptions of those same parts will not be repeated here.

Figure 4A:
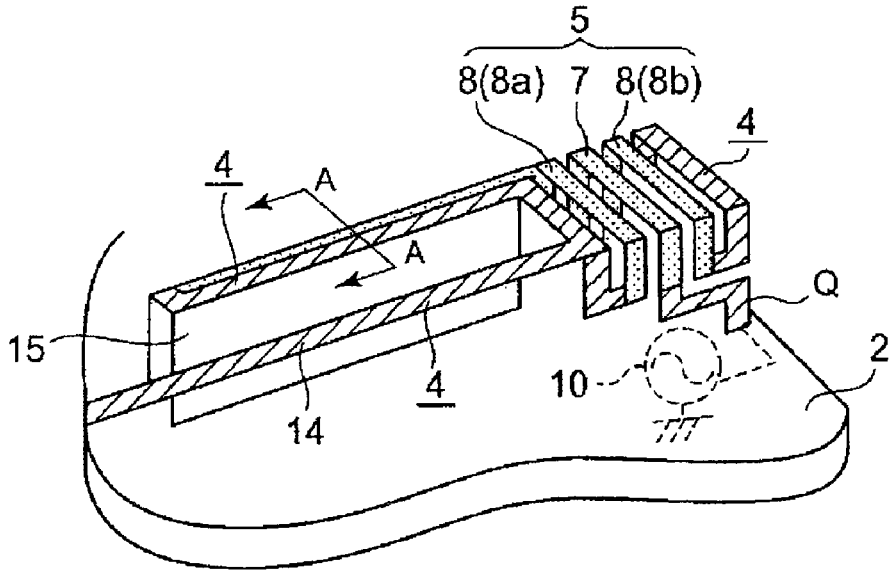
FIG. 4*a* is a schematic perspective view for explaining an antenna structure according to a second embodiment.
Figure 4B:
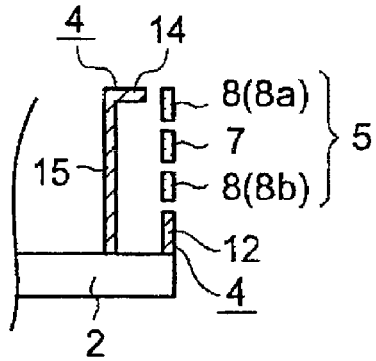
FIG. 4*b* is a schematic sectional view of a portion taken along a line A-A of FIG. 4*a*.

FIG. 4*a* shows a state where parts characteristic to the antenna structure 1 according to the second embodiment are extracted and the base member 3 is omitted. FIG. 4*b* shows a schematic sectional view of a portion taken along a line A-A of FIG. 4*a*.

When the feed radiation electrode 4 performs a resonant operation and performs radio communication, a slight current flows through the stub 5 and a radio wave unnecessary for radio communication is emitted from the stub 5. In the antenna structure 1 according to the second embodiment, the leading end of the stub 5 and both sides of the stub 5 are surrounded by the feed radiation electrode 4 and the branch electrode 12 with gaps therebetween, as in the first embodiment. The feed radiation electrode 4 and the branch electrode 12 that surround the stub 5 have a function of shielding the stub 5. Thus, the feed radiation electrode 4 and the branch electrode 12 are capable of preventing an unwanted radio wave emitted as noise from the stub 5 being superimposed on a radio wave for radio communication of the feed radiation electrode 4. In the second embodiment, in addition, a shielding member 15 for more reliably suppressing a degradation of the signal-to-noise ratio of radio waves for radio communication of the feed radiation electrode 4 to be caused by emission of unwanted radio waves from the stub 5 is also provided.

That is, in the second embodiment, the shielding member 15 formed of a conductive plate that faces all the central conductor 7 and the external conductors 8*a* and 8*b* of the stub 5 with gaps therebetween is provided in the base member 3. The shielding member 15 is electrically connected to the feed radiation electrode 4 and the branch electrode 12. The other features of the configuration of the antenna structure 1 according to the second embodiment are similar to those of the first embodiment. In the second embodiment, not only do the feed radiation electrode 4 and the branch electrode 12 surround the stub 5 to shield the stub 5, but the shielding member 15, as well as the electrodes 4 and 12, is also provided. Thus, unwanted radio waves emitted from the stub 5 can be shielded more reliably. Consequently, a deterioration in the radio communication performance of the antenna structure 1 to be caused by emission of unwanted radio waves from the stub 5 can be more suppressed.

Figure 5:
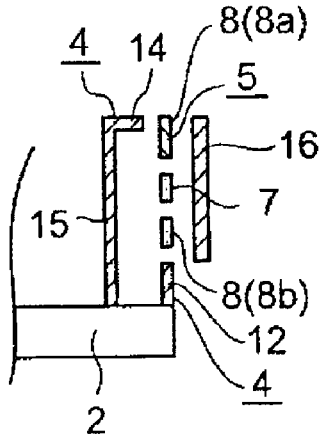
FIG. 5 is a schematic sectional view for explaining another example of the configuration of a shielding member.

In the examples shown in FIGS. 4*a* and 4*b*, the shielding member 15 is provided in the base member 3. However, for example, as shown in FIG. 5 (FIG. 5 is a schematic sectional view of a position corresponding to the portion taken along the line A-A of FIG. 4*a*, and the base member 3 is omitted in FIG. 5), in addition to the shielding member 15, another shielding member 16 formed of a conductive plate that faces all the central conductor 7 and the external conductors 8*a* and 8*b* of the stub 5 with gaps therebetween may be provided outside the base member 3. The shielding member 16 may be provided integrally with the base member 3 or may be provided in a casing (not shown) in which the circuit board 2 is accommodated in a portion that faces the front surface 3*f* of the base member 3 with a gap therebetween. Similarly to the shielding member 15, the shielding member 16 is electrically connected to the feed radiation electrode 4 and the branch electrode 12. In addition, although an example in which both the shielding members 15 and the shielding member 16 are provided is shown in FIG. 5, only the shielding member 16 may be provided without providing the shielding member 15.

A third embodiment will be described below. In the description of the third embodiment, the same parts as in each of the first and second embodiments are represented by the same reference numerals and the descriptions of those same parts will not be repeated here.

Figure 6:
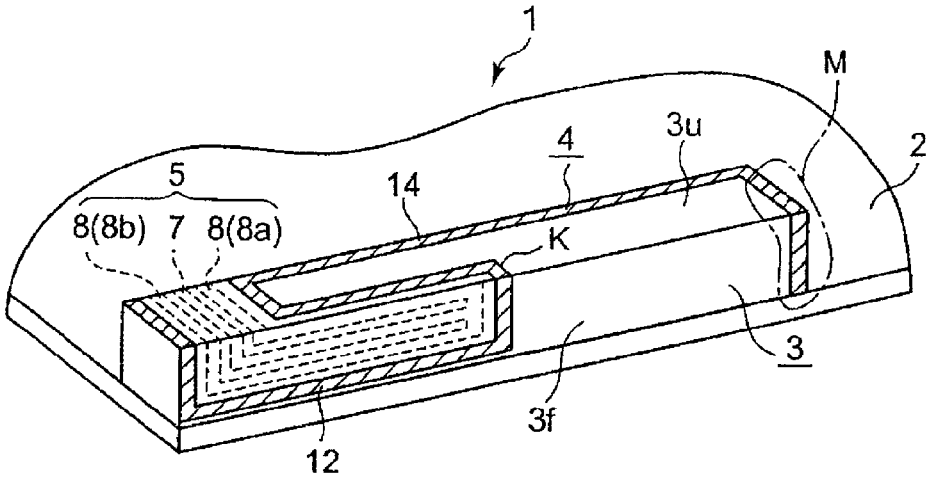
FIG. 6 is an illustration for explaining a third embodiment.

FIG. 6 shows a schematic perspective view of the antenna structure 1 according to the third embodiment. In the third embodiment, the stub 5 is provided in the base member 3. The other features of the configuration of the antenna structure 1 according to the third embodiment are similar to those of each of the first and second embodiments. Although the entire stub 5 is provided in the base member 3 in the example shown in FIG. 6, only part of the stub 5 may be provided in the base member 3. In addition, only the stub 5 is provided in the base member 3 in the example shown in FIG. 6, the entire or part of the feed radiation electrode 4, as well as the stub 5, may be formed in the base member 3. Furthermore, instead of forming the stub 5 in the base member 3, the entire or part of the feed radiation electrode 4 may be formed in the base member 3.

As described above, with the configuration in which at least part of the stub 5 is formed in the base member 3, a wavelength shortening effect to be exerted on the stub 5 due to the dielectric constant of the base member 3 is further increased. Thus, a further reduction in the size of the stub 5 can be achieved. Therefore, a reduction in the size of the antenna structure 1 can be achieved. In addition, with the configuration in which at least part of the feed radiation electrode 4 is formed in the base member 3, a wavelength shortening effect to be exerted on the feed radiation electrode 4 due to the dielectric constant of the base member 3 is further increased. Thus, a further reduction in the size of the feed radiation electrode 4 can be achieved. Therefore, a reduction in the size of the antenna structure 1 can be achieved.

A fourth embodiment will be described below. In the description of the fourth embodiment, the same parts as in each of the first to third embodiments are represented by the same reference numerals and the descriptions of those same parts will not be repeated here.

Figure 7:
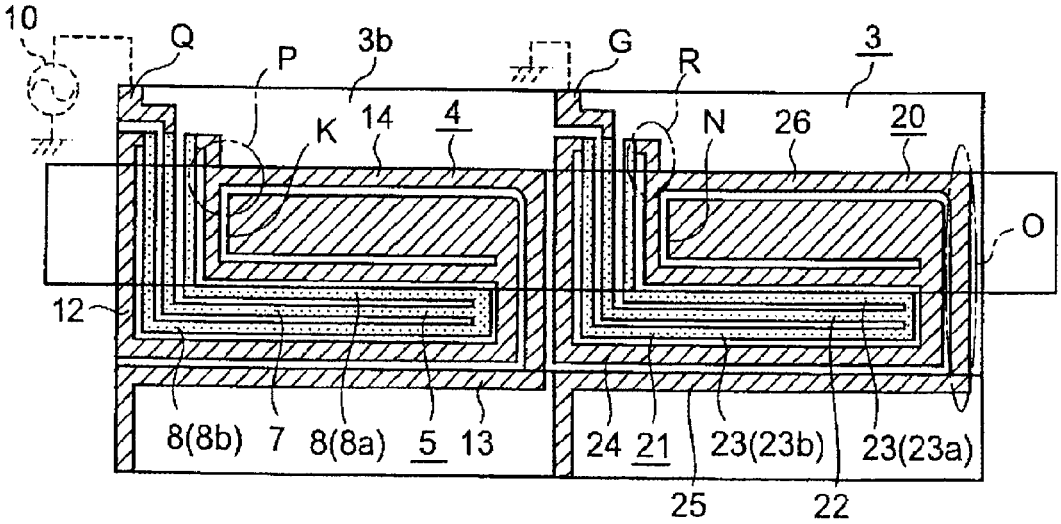
FIG. 7 is an illustration for explaining a fourth embodiment.

FIG. 7 shows a schematic development view of the base member 3 constituting the antenna structure 1 according to the fourth embodiment. In the fourth embodiment, a parasitic radiation electrode 20, as well as the feed radiation electrode 4, is provided on the base member 3. The feed radiation electrode 4 shown in FIG. 7 has a shape that is substantially similar to that of the feed radiation electrode 4 shown in FIG. 1*a*, FIG. 6, or the like. In the case of the feed radiation electrode 4 shown in FIG. 1*a* or the like, the branch electrode 12 branches off from the open end K. In contrast, in the case of the feed radiation electrode 4 shown in FIG. 7, the branch electrode 12 branches off from a feed radiation electrode portion in the middle from the feeding-end adjacent portion P to the open end K. As in each of the first to third embodiments, the feed radiation electrode 4 shown in FIG. 7 is also connected to the stub 5 and has a configuration in which radio communication can be achieved in two different frequency bands, a lower frequency band and a higher frequency band, defined in advance for radio communication.

The parasitic radiation electrode 20 is provided adjacent to the feed radiation electrode 4 with a gap therebetween. The parasitic radiation electrode 20 is electromagnetically coupled to the feed radiation electrode 4 and generates a multi-resonance state together with the feed radiation electrode 4. The parasitic radiation electrode 20 shown in FIG. 7 has the configuration described below in order to generate a multi-resonance state in both the lower frequency band and the higher frequency band for radio communication in which the feed radiation electrode 4 performs radio communication.

That is, in order that the parasitic radiation electrode 20 generates a multi-resonance state together with the feed radiation electrode 4, a frequency near the resonant frequency $F_L$ of the feed radiation electrode 4 in the lower frequency band for radio communication is set in advance as a resonant frequency $f_L$ of the parasitic radiation electrode 20, and a frequency near the resonant frequency $F_H$ of the feed radiation electrode 4 in the higher frequency band for radio communication is set in advance as a resonant frequency $f_H$ of the parasitic radiation electrode 20. The parasitic radiation electrode 20 has a loop shape similar to that of the feed radiation electrode 4. One end of the parasitic radiation electrode 20 serves as a grounded end G that is grounded, and the other end of the parasitic radiation electrode 20 serves as an open end N.

The grounded end G and a grounded-end adjacent portion R of the parasitic radiation electrode 20 are electrically connected with a stub 21 therebetween. The stub 21 has a configuration similar to that of the stub 5, which is connected to the feed radiation electrode 4. The stub 21 is configured such that a central conductor 22 and external conductors 23 (23*a* and 23*b*) provided on sides of the central conductor 22 are arranged and provided with gaps therebetween and leading ends (connection ends) of the central conductor 22 and the external conductors 23 (23*a* and 23*b*) are electrically connected. A rear end of the central conductor 22 of the stub 21 is connected to the grounded end G of the parasitic radiation electrode 20, a rear end of the external conductor 23*a* is electrically connected to the grounded-end adjacent portion R of the parasitic radiation electrode 20, and a rear end of the external conductor 23*b* is electrically connected to a leading end of a branch electrode 24 branching off from a portion in the middle from the grounded-end adjacent portion R to the open end N of the parasitic radiation electrode 20.

The stub 21 has an impedance characteristic in which the stub 21 appears to have a high impedance when the leading end of the stub 21 is viewed from the grounded end G at the resonant frequency $f_L$ set for a parasitic radiation electrode in the lower frequency band for radio communication and the stub 21 appears to have a low impedance when the leading end of the stub 21 is viewed from the grounded end G at the resonant frequency $f_H$ set for a parasitic radiation electrode in the higher frequency band for radio communication.

The parasitic radiation electrode 20 has a loop shape, as described above, and the grounded end G and the grounded-end adjacent portion R are electrically connected with the stub 21 therebetween. In the parasitic radiation electrode 20, the electrical length starting from the grounded end G, passing through the stub 21, extending along an extension portion 26 in a backward direction of the parasitic radiation electrode 20, and reaching a folded area O in an extension direction is similar to the electrical length starting from the grounded end G, passing through an extension portion 25 in a forward direction of the parasitic radiation electrode 20, and reaching the folded area O in the extension direction. This electrical length is defined as an electrical length in which the parasitic radiation electrode 20 performs a resonant operation at the resonant frequency $f_H$ set for a parasitic radiation electrode in the higher frequency band for radio communication. In addition, the total electrical length from the grounded end G to the open end N of the parasitic radiation electrode 20 is defined as an electrical length in which the parasitic radiation electrode 20 performs a resonant operation at the resonant frequency $f_L$ set for a parasitic radiation electrode in the lower frequency band for radio communication. Thus, in the parasitic radiation electrode 20, a current flows in both the lower and higher frequency bands for radio communication, as in the feed radiation electrode 4, and the parasitic radiation electrode 20 performs resonant operations at the set resonant frequencies $f_L$ and $f_H$, thus achieving a multi-resonance state together with the feed radiation electrode 4.

The other features of the configuration of the antenna structure 1 according to the fourth embodiment are similar to those of each of the first to third embodiments. In the fourth embodiment, with the configuration in which the parasitic radiation electrode 20 is provided and a multi-resonance state is generated by the feed radiation electrode 4 and the parasitic radiation electrode 20, a further increase in a frequency bandwidth for radio communication and a further improvement in the antenna characteristic can be achieved. In particular, in the fourth embodiment, the stub 21 having a shape similar to that of the stub 5, which is connected to the feed radiation electrode 4, is connected to the parasitic radiation electrode 20 in a similar connection manner. Thus, the parasitic radiation electrode 20 is capable of generating a multi-resonance state together with the feed radiation electrode 4 in each frequency band in which the feed radiation electrode 4 performs a resonant operation for radio communication. Therefore, a multi-resonance state can be achieved in all the frequency bands set for radio communication, thus achieving an increase in the frequency bandwidth and an improvement in the antenna characteristic. Consequently, the antenna structure 1 having a high reliability with respect to the antenna performance can be provided. Although the parasitic radiation electrode 20 is configured to generate a multi-resonance state in both the lower frequency band and the higher frequency band in which the feed radiation electrode 4 performs radio communication, the parasitic radiation electrode may be configured to generate a multi-resonance state only in one of the higher and lower frequency bands. In this case, no stub is connected to the parasitic radiation electrode.

In addition, one of the parasitic radiation electrode 20 and the stub 21 connected to the parasitic radiation electrode 20, or the entire or part of both the parasitic radiation electrode 20 and the stub 21 connected to the parasitic radiation electrode 20 may be provided in the base member 3. Furthermore, in the case that the stub 21 is connected to the parasitic radiation electrode 20, a shielding member serving as a shield against unwanted radio waves emitted from the stub 21 connected to the parasitic radiation electrode 20 may be provided. For example, such a shielding member has a configuration similar to those of the shielding members 15 and 16, which are provided for the stub 5 for the feed radiation electrode 4, as described in the second embodiment.

Moreover, the gap between the feed radiation electrode 4 and the parasitic radiation electrode 20, a position of the parasitic radiation electrode 20 that is provided adjacent to the feed radiation electrode 4, and the like are not limited to the example shown in FIG. 7 and should be appropriately set such that the feed radiation electrode 4 and the parasitic radiation electrode 20 can generate an excellent multi-resonance state.

A fifth embodiment will be described below. The fifth embodiment pertains to a radio communication apparatus. The radio communication apparatus according to the fifth embodiment includes any one of the antenna structures 1 according to the first to fourth embodiments. The radio communication apparatus has various features of the configuration other than those of the parts relating to an antenna. In the fifth embodiment, any appropriate features of the configuration other than those of the parts relating to the antenna can be adopted, and the explanation of those features will be omitted. In addition, since the description of the antenna structure 1 has been provided above, the description of the antenna structure 1 will be omitted here.

Figure 8A:
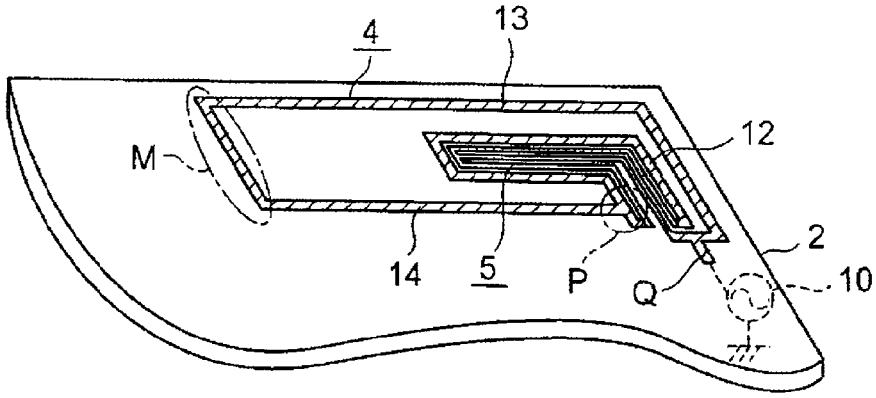
FIG. 8*a* is an illustration for explaining another embodiment.
Figure 8B:
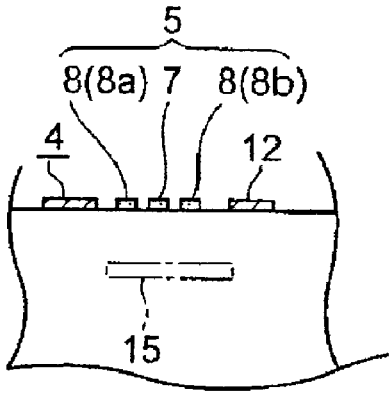
FIG. 8*b* is a schematic sectional view for explaining still another embodiment.

The present invention is not limited to any of the first to fifth embodiments, and various embodiments can be adopted. For example, although the feed radiation electrode 4 and the stub 5 are formed on the base member 3 in each of the first to fifth embodiments, for example, the feed radiation electrode 4 and the stub 5 may be provided on a board surface of the circuit board 2, as shown in FIG. 8*a*. In this case, the base member 3 can be omitted. In the case that the feed radiation electrode 4 and the stub 5 are provided on the board surface of the circuit board 2, for example, the shielding member 15 serving as a shield against unwanted radio waves from the stub may be provided in the circuit board 2, as represented by a chain line in a schematic sectional view of FIG. 8*b*.

Figure 8C:
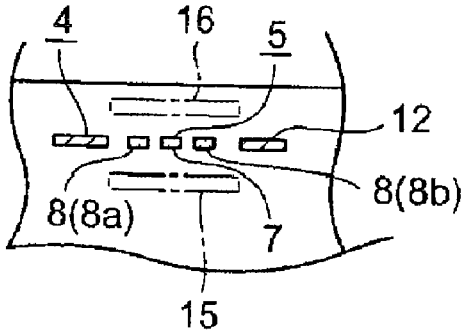
FIG. 8*c* is a schematic sectional view for explaining still another embodiment.

In addition, as shown in a schematic sectional view of FIG. 8*c*, the feed radiation electrode 4 and the stub 5 may be provided in the circuit board 2. Furthermore, the entire or part of one of the feed radiation electrode 4 and the stub 5 may be formed on the board surface of the circuit board 2 and the other portions may be formed in the circuit board 2. In the case that the stub 5 is provided in the circuit board 2, the shielding members 15 and 16 may be provided so as to sandwich the stub 5 from upper and lower sides therebetween, as represented by a chain line of FIG. 8*c*. Thus, the shielding performance for the stub 5 can be further increased.

Moreover, in the case that the parasitic radiation electrode 20 is provided, the parasitic radiation electrode 20 may be provided on the board surface of the circuit board 2 or inside the circuit board 2. In addition, in the case that the stub 21 is connected to the parasitic radiation electrode 20, the stub 21 may be provided on the board surface of the circuit board 2 or inside the circuit board 2. As described above, in the case that the feed radiation electrode 4, the parasitic radiation electrode 20, and the stubs 5 and 21 are provided on the board surface of the circuit board 2 or at least parts of the feed radiation electrode 4, the parasitic radiation electrode 20, and the stubs 5 and 21 are provided inside the circuit board 2, due to a wavelength shortening effect corresponding to the dielectric constant of the circuit board 2, reductions in the sizes of the feed radiation electrode 4, the parasitic radiation electrode 20, and the stubs 5 and 21 can be achieved.

In addition, although the entire feed radiation electrode 4 is provided on the base member 3 in each of the first to fifth embodiments, in the case of a configuration in which part of the feed radiation electrode 4 is formed on the bottom surface 3*d* of the base member 3, as shown in FIG. 1*c* or the like, a feed radiation electrode portion formed on the bottom surface 3*d* of the base member 3 may be provided on the circuit board 2, not on the bottom surface 3*d* of the base member 3, so that the feed radiation electrode portion provided on the circuit board 2 can be electrically connected to a feed radiation electrode portion formed on the base member 3. Similarly, in the case where the parasitic radiation electrode 20 is provided, in the case of a configuration in which part of the parasitic radiation electrode 20 is formed on the bottom surface 3*d* of the base member 3, a parasitic radiation electrode portion formed on the bottom surface 3*d* of the base member 3 may be provided on the circuit board 2, not on the base member 3, so that the parasitic radiation electrode portion provided on the circuit board 2 can be electrically connected to a parasitic radiation electrode portion formed on the base member 3.

In addition, although the feed radiation electrode 4 is a monopole antenna in each of the first to fifth embodiments, the feed radiation electrode 4 may be an inverted-F antenna. In this case, a grounding electrode for electrically grounding the vicinity of the feeding end Q of the feed radiation electrode 4 to achieve impedance matching with the radio communication circuit 10 is provided. In addition, although only one feed radiation electrode 4 is provided in each of the first to fifth embodiments, a plurality of feed radiation electrodes may be provided. In the case that a plurality of feed radiation electrodes are provided, all the feed radiation electrodes may have a configuration similar to that of the feed radiation electrode 4 described in each of the first to fifth embodiment. Alternatively, some feed radiation electrodes selected from among all the feed radiation electrodes may have a configuration similar to that of the feed radiation electrode 4 described in each of the first to fifth embodiments. Similarly, regarding a parasitic radiation electrode, a plurality of parasitic radiation electrodes may be provided. Stubs may be connected to all the parasitic radiation electrodes as described in the fourth embodiment. Alternatively, stubs may be connected only to some parasitic radiation electrodes selected from among all the parasitic radiation electrodes.

In addition, although the base member 3 has the same dielectric constant over the entire base member 3, a portion of the base member 3 where the stubs 5 and 21 are formed may have a dielectric constant higher than those of the other portions of the base member 3. In addition, in the case that the stubs 5 and 21 are formed on the surface of the base member 3 or on the board surface of the circuit board 2, a conductive member having a dielectric constant higher than that of the base member 3 or the circuit board 2 may be provided above the stubs 5 and 21. With this configuration, due to a high dielectric constant of the base portion or a circuit board portion where the stubs 5 and 21 are formed, a wavelength shortening effect to be exerted on the stubs can be further increased, thus reducing the lengths of the stubs. That is, a reduction in the size can be achieved.

Since the present invention achieves advantages of a reduction in the size of an antenna structure and an improvement of the antenna characteristic, the present invention is suitable for an antenna structure and a radio communication apparatus for which a small size and a high communication performance are required.

Although particular embodiments have been described, many other variations and modifications and other uses will become apparent to those skilled in the art. Therefore, the present invention is not limited by the specific disclosure herein.

What is claimed is:

1. An antenna structure capable of implementing radio communication in two different frequency bands, a higher frequency band and a lower frequency band, the antenna structure comprising:

a feed radiation electrode that is located on a surface associated with a circuit board and that functions as an antenna in accordance with a resonant operation, wherein one end of the feed radiation electrode serves as a feeding end and the other end of the feed radiation electrode serves as an open end, an electrical length from the feeding end to the open end of the feed radiation electrode is the same as an electrical length in which the feed radiation electrode performs a resonant operation at a resonant frequency set in the lower frequency band, and the feed radiation electrode has a loop shape such that the feed radiation electrode starts at the feeding end, extends in a forward direction that is directed away from the feeding end, turns around so as to extend in a backward direction that approaches the feeding end, passes through a feeding-end adjacent portion that is arranged adjacent to the feeding end with a gap therebetween, and reaches the open end, wherein the feeding-end adjacent portion and the feeding end of the feed radiation electrode are electrically connected with a shortcut path therebetween, the shortcut path being provided by a stub, wherein the stub includes a line-shaped central conductor and first and second line-shaped external conductors arranged so as to sandwich the central conductor on both sides of the central conductor with gaps therebetween, the central conductor and the external conductors are located on a board surface of the circuit board or on at least one surface of a base member provided on the circuit board, and a leading end of the central conductor and leading ends of each of the first and second external conductors are electrically connected; and wherein a rear end, which is opposite to the leading end, of the central conductor is electrically connected to the feeding end of the feed radiation electrode, and a rear end of the first and second external conductors is electrically connected to the feeding-end adjacent portion of the feed radiation electrode.

2. The antenna structure according to claim 1, wherein said feed radiation electrode is located on the board surface of said circuit board.

3. The antenna structure according to claim 1, wherein said feed radiation electrode is located on at least one surface of the base member provided on the circuit board.

4. The antenna structure according to claim 1, wherein the stub appears to have a high impedance when a leading end of the stub is viewed from the feeding end of the feed radiation electrode at the resonant frequency set in the lower frequency band, and the stub appears to have a low impedance when the leading end of the stub is viewed from the feeding end of the feed radiation electrode at a resonant frequency set in the higher frequency band.

5. The antenna structure according to claim 1 or 4, wherein, when radio communication is performed in the higher frequency band, in the feed radiation electrode, currents flow through two channels, a channel starting from the feeding end, passing through an extension portion in the forward direction of the loop shape, and extending toward a folded area in an extension direction of the feed radiation electrode and a channel starting from the feeding end, passing through the shortcut path and the feeding-end adjacent portion, extending along an extension portion in the backward direction of the loop shape, and extending toward the folded area in the extension direction of the feed radiation electrode, and the feed radiation electrode performs a resonant operation at the resonant frequency set in the higher frequency band, and when radio communication is performed in the lower frequency band, in the feed radiation electrode, a current flows through a channel starting from the feeding end, passing through the extension portion in the forward direction and the extension portion in the backward direction of the loop shape in that order, and extending toward the open end, and the feed radiation electrode performs a resonant operation at the resonant frequency set in the lower frequency band.

6. The antenna structure according to claim 1 or 4, wherein a feed radiation electrode portion that is closer to the open end than the feeding-end adjacent portion is provided along one of the first and second external conductors with a gap therebetween, and a branch electrode is provided and branches off from the feed radiation electrode portion closer to the open end than the feeding-end adjacent portion, the branch electrode is provided along the leading end of the stub and the other one of the first and second external conductors with gaps therebetween and is connected to a rear end of the other one of the first and second external conductors, and from the leading end of the stub, the stub is surrounded on both sides by the feed radiation electrode and the branch electrode with gaps therebetween.

7. The antenna structure according to claim 1 or 4, wherein at least part of the stub is located in the circuit board or in the base member provided thereon.

8. The antenna structure according to claim 1 or 4, wherein at least part of the feed radiation electrode is located in the circuit board or in the base member provided thereon.

9. The antenna structure according to claim 1 or 4, further comprising a shielding member serving as a shield against an unwanted radio wave emitted from the stub.

10. The antenna structure according to claim 1 or 4, further comprising a parasitic radiation electrode that is provided adjacent to the feed radiation electrode with a gap therebetween and that is capable of generating a multi-resonance state by performing a resonant operation together with the feed radiation electrode in accordance with electromagnetic coupling with the feed radiation electrode.

11. The antenna structure according to claim 10, wherein the parasitic radiation electrode generates, together with the feed radiation electrode, a multi-resonance state in each of the higher and lower frequency bands in which the feed radiation electrode performs a resonant operation for the radio communication, the parasitic radiation electrode has a loop shape similar to that of the feed radiation electrode, another shortcut path provided with another stub is connected to the parasitic radiation electrode, and the parasitic radiation electrode performs resonant operations at resonant frequencies set for the parasitic radiation electrode in the higher and lower frequency bands.

12. The antenna structure according to claim 1 or 4, wherein a portion of the surface associated with the circuit board where the stub is formed has a dielectric constant higher than those of the other portions of said surface.

13. A radio communication apparatus comprising the antenna structure according to claim 1 or 4, and a radio frequency circuit connected to said feeding end.

* * * * *